US012116781B1

(12) United States Patent
Yin et al.

(10) Patent No.: US 12,116,781 B1
(45) Date of Patent: Oct. 15, 2024

(54) WEB MEMBER FOR TRUSS WITH HIGH SECTIONAL STRENGTH AND ASSEMBLED TRUSS

(71) Applicant: Nantong Ouben Construction Technology Co., Ltd., Nantong (CN)

(72) Inventors: Jianyou Yin, Nantong (CN); Ming Chen, Nantong (CN); Jiamei Chen, Nantong (CN); Peng Tang, Nantong (CN)

(73) Assignee: Nantong Ouben Construction Technology Co., Ltd., Nantong (CN)

( * ) Notice: Subject to any disclaimer, the term of this patent is extended or adjusted under 35 U.S.C. 154(b) by 0 days.

(21) Appl. No.: 18/571,629

(22) PCT Filed: Sep. 18, 2023

(86) PCT No.: PCT/CN2023/119356
§ 371 (c)(1),
(2) Date: Dec. 18, 2023

(30) Foreign Application Priority Data

Aug. 11, 2023 (CN) ..... 202322177268.X

(51) Int. Cl.
*E04C 3/08* (2006.01)
*E04C 3/04* (2006.01)

(52) U.S. Cl.
CPC ..... *E04C 3/08* (2013.01); *E04C 2003/0491* (2013.01)

(58) Field of Classification Search
CPC ..... E04C 3/08; E04C 2003/0491; E04C 2003/026; E04C 3/16; E04C 2003/0473
(Continued)

(56) References Cited

U.S. PATENT DOCUMENTS 464,996 A * 12/1891 Rouse ..... A47C 7/02 52/690
1,813,044 A * 7/1931 Franks ..... E21B 15/00 52/645

(Continued)

FOREIGN PATENT DOCUMENTS

CN 107605100 A 1/2018
CN 207686133 U 8/2018

(Continued)

OTHER PUBLICATIONS

International Search Report, issued in PCT/CN2023/119356, issued by ISA, dated Oct. 14, 2023.

(Continued)

*Primary Examiner* — Brian E Glessner
*Assistant Examiner* — Adam G Barlow
(74) *Attorney, Agent, or Firm* — Zhu Lehnhoff LLP

(57) ABSTRACT

A web member for a truss with high sectional strength and an assembled truss is formed by transforming ends of an M-shaped web member into two double-layer connecting plates for connection through end transformation, grooving and drilling while steel consumption is not increased; and connection joints of a conventional truss are usually controlled by bearing capacities of bolts of which the sectional strength is insufficient, the thickness of bolt connections on ends of the web member is increased by flattening, and thus, pressure bearing capacities of the bolts will be greatly improved. The truss provided by the present utility model is a fully-bolted truss, connections of two adjacent web members and chord members are connected to intersection points of center-of-gravity lines of the web members and the chord members.

4 Claims, 5 Drawing Sheets

(58) Field of Classification Search
USPC .... 52/289, 650.1, 650.2, 690, 693, 694, 695
See application file for complete search history.

(56) References Cited

U.S. PATENT DOCUMENTS 1,863,817 A * 6/1932 Wells ..... E04B 5/14 52/693
1,924,881 A * 8/1933 Earl ..... B64C 1/08 52/693
3,122,224 A * 2/1964 Blickensderfer ..... E04C 3/09 52/694
3,353,320 A * 11/1967 Grasis ..... E04H 12/10 52/693
3,422,591 A * 1/1969 Troutner ..... E04C 3/292 52/693
3,925,951 A * 12/1975 Jackson ..... E04C 3/292 52/693
4,089,148 A * 5/1978 Oehmsen ..... E04C 3/40 52/645
4,395,615 A 7/1983 Tanenbaum
4,615,157 A * 10/1986 Murray ..... F16B 5/0241 52/693
4,653,237 A * 3/1987 Taft ..... E04B 5/40 52/693
4,750,309 A * 6/1988 Reetz ..... E04C 3/292 52/693
4,833,841 A * 5/1989 Ellington, III ..... E04B 1/3483 52/690
4,872,299 A * 10/1989 Troutner ..... E04C 3/292 52/693
6,799,406 B2 * 10/2004 Gosselin ..... B21D 47/04 52/696
10,392,803 B2 * 8/2019 Charest ..... E04C 3/292
2002/0069606 A1 * 6/2002 Gosselin ..... E04C 3/08 52/690
2012/0216475 A1 * 8/2012 Safari Kermanshahi ..... E04C 3/086 52/309.4
2013/0312361 A1 * 11/2013 Robinson ..... E04C 3/08 52/690
2014/0075875 A1 * 3/2014 Dayton ..... E04B 5/40 52/655.1
2014/0075877 A1 * 3/2014 Robinson ..... E04C 3/08 52/690
2018/0155918 A1 * 6/2018 De Almeida Borges ..... E04B 7/10
2019/0177965 A1 * 6/2019 De Almeida Borges ..... E04B 7/022

FOREIGN PATENT DOCUMENTS

CN 209585424 U 11/2019
CN 113389318 A 9/2021
CN 116241012 A 6/2023
GB 659285 A 10/1951

OTHER PUBLICATIONS

International Search Report, issued in PCT/CN2023/119356, issued by ISA, dated Oct. 13, 2023.

* cited by examiner

WEB MEMBER FOR TRUSS WITH HIGH SECTIONAL STRENGTH AND ASSEMBLED TRUSS

TECHNICAL FIELD

The present invention relates to the technical field of steel structural buildings, in particular to an assembled truss.

BACKGROUND

Most of members in a truss bear axial tensions or pressures, so that the strength of a material can be sufficiently utilized. When there is a greater span, the members save more materials than a solid web girder, and are reduced in self-weight and increased in rigidity. Especially, the members are widely applied and popularized in projects with greater spans or heavier loads and strict deformation requirements. A traditional truss is assembled by adopting a certain welding process according to different weld joint forms after assembly and is made of a common steel plate for a building: due to anticorrosion, after being assembled, the truss is processed by adopting derusting and coating processes and is then delivered; and by welding and coating, a lot of harmful gases will be generated, it is not easy to guarantee the quality, the anticorrosion time is also limited to a certain extent after coating, and the truss is required to be periodically maintained. There is also another form of the truss, it is also connected by using bolts, chord members are mounted in two pieces, and the members are scattered, which easily causes sidewise bending of the truss: web members and the chord members are connected at independent connection joints where secondary bending moments are easily generated, which causes the increase of the structural stress, so that the bearing capacity of the truss is lowered, and the structural safety of the overall building is lowered; and more bolts are needed, so that the economic efficiency is reduced.

SUMMARY

The purpose of the present invention is to provide a web member for a truss with high sectional strength and an assembled truss to solve the problems in the background art that an existing assembled truss easily generates secondary bending moments on connection joints and is increased in structural stress and lowered in bearing capacity.

In order to achieve the above-mentioned purpose, the present invention provides a web member for a truss with high sectional strength, wherein ends of the web member are flattened to end plates on two sides after a web plate is grooved, so that the end plates on two sides form double-layer connecting plates, and bolt holes for connection are formed in surfaces of the double-layer connecting plates.

Further, a middle section of the web member is M-shaped.

The present invention further provides a fully-bolted assembled truss, including an upper chord member, a lower chord member and a plurality of web members; and the upper chord member being parallel to the lower chord member, sections of the upper chord member and the lower chord member being Ω-shaped sections, and middles thereof being bulges for connecting the web members: bolt holes for connection being equidistantly formed in sides of the bulges, and the bulges being clamped between the double-layer connecting plates on two sides of the web plate and being fixedly connected by using bolts.

Further, the plurality of web members are connected end to end and are arranged between the upper chord member and the lower chord member in order, and ends of two adjacent web members are connected to the same bolt joint of the upper chord member or the lower chord member; and the double-layer connecting plates of the two adjacent web members on the same bolt joint are internally and externally staggered.

Further, the truss is fixed together with a roof beam through a support assembly.

Further, the support assembly includes a support and end support connecting pieces:

the support is fixed to the roof beam, and the end support connecting pieces are two L-shaped steel plates symmetrically disposed on a surface of the support and are fixed together with the support by using bolts; and the bulges on the ends of the upper chord member are clamped between the two end support connecting pieces and are fixed by using bolts.

Further, a trapezoidal groove matched with vertical sections of the bulges in shape is formed between the two end support connecting pieces.

Further, ends of the lower chord member are lapped-joint on a lower flange of the roof beam.

Compared with the prior art, the present invention has the advantages that:

1. in the present invention, ends of an M-shaped web member are skillfully transformed into two double-layer connecting plates for connection through end transformation, grooving and drilling; and connection joints of a conventional truss are usually controlled by bearing capacities of bolts of which the sectional strength is never sufficient, the thickness of bolt connections on ends of the web member is increased by flattening, and thus, pressure bearing capacities of the bolts will be greatly improved.
2. The overall truss is fully-bolted, so that an important welding process is omitted, and it is easier to guarantee the quality; and by adopting mechanical line production, requirements of professional skills of workers during member manufacturing are lowered.
3. The fully-bolted truss can be made of fully-galvanized materials including galvanized bolts, so that the coating process is omitted, the economic efficiency is further increased, and the anticorrosion time is greatly prolonged: the connections of the two web members and the chord members are connected to the intersection points of the center-of-gravity lines of the web members and the chord members, so that the secondary bending moments of the chord members on the joints are avoided, the bearing capacity of the truss is further improved, and then, a heavier load is borne on a smaller sectional area; and the quality and the economic efficiency are greatly improved.

DETAILED DESCRIPTION OF THE PREFERRED EMBODIMENTS

In order to make objectives, technical solutions and advantages of the present invention clearer, the technical solutions in the present invention will be further described below.

Figure 1:
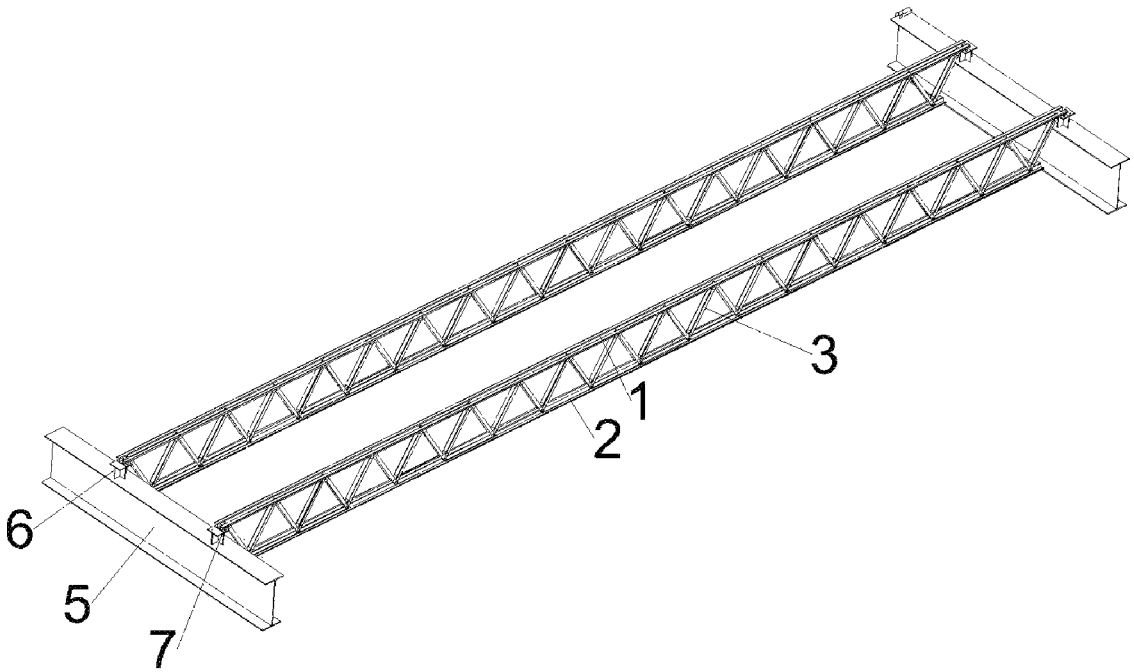
FIG. 1 is a schematic diagram of an overall structure of an assembled truss in an embodiment of the present invention.
Figure 4:
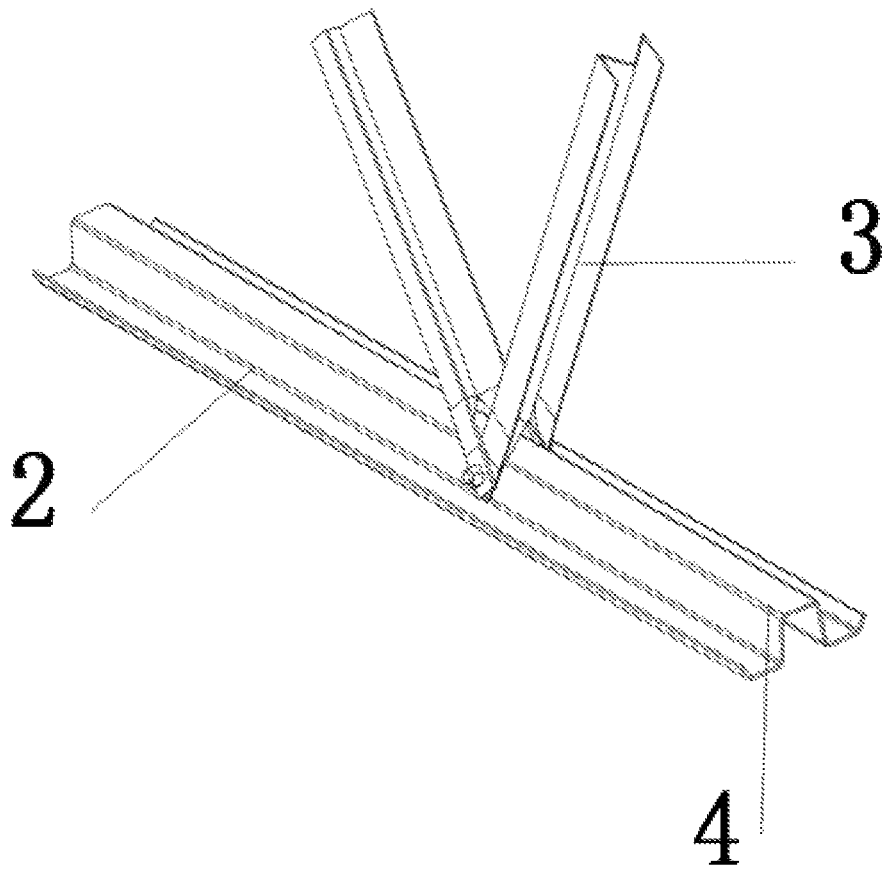
FIG. 4 is a schematic diagram of the assembly of two adjacent web members on the same joint of chord members in an embodiment of the present invention.
Figure 5:
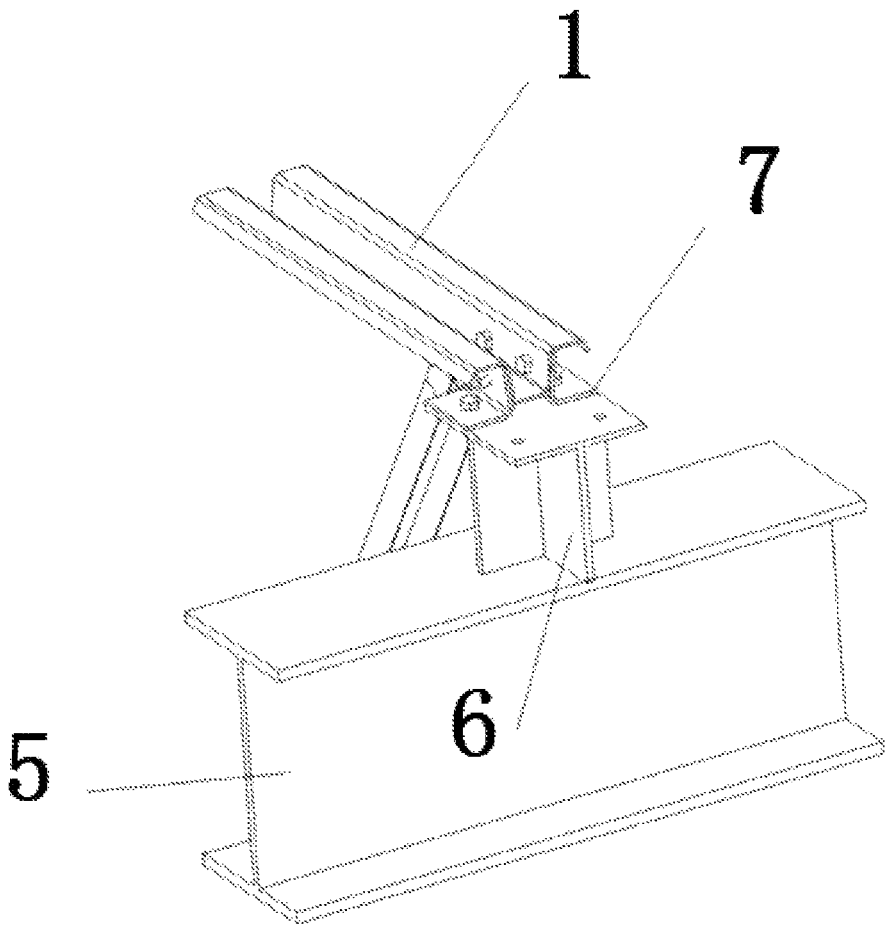
FIG. 5 is a schematic diagram of an assembly structure of chord members and a roof beam in an embodiment of the present invention.

As shown in FIG. 1, the present invention provides an assembled truss, including an upper chord member 1, a lower chord member 2 and a plurality of web members 3:

the upper chord member 1 is parallel to the lower chord member 2, sections of the upper chord member 1 and the lower chord member 2 are 2-shaped sections as shown in FIG. 4, and flanges on two ends of the upper chord member 1 and the lower chord member 2 deflect for a certain angle in a vertical direction: middles of the upper chord member 1 and the lower chord member 2 are bulges 4 for connecting the web members 3: bolt holes for connection are equidistantly formed in sides of the bulges 4 and are used to be connected to the web members 3, and bolt holes in ends are shown in FIG. 5 and are used to be connected to support connecting pieces.

Figure 2:
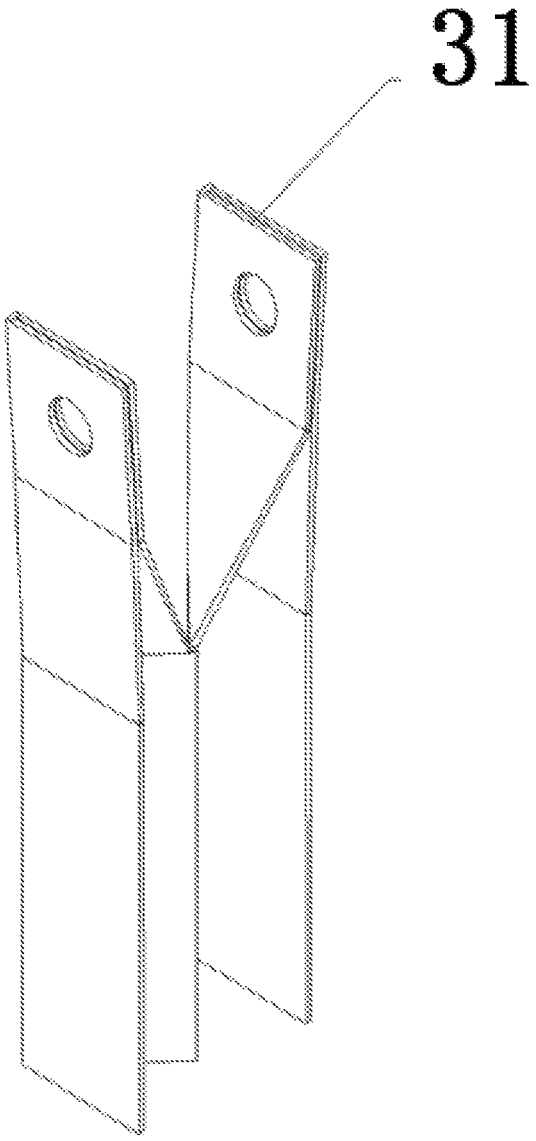
FIG. 2 is a schematic diagram of a three-dimensional structure of a web member in an embodiment of the present invention.

In the present invention, the structure of a web plate is adopted for realizing the characteristic of high sectional strength. As shown in FIG. 2, in the present embodiment, each web member 3 is an M-shaped web member 3, ends of the web member 3 are flattened to end plates on two sides after the web plate is grooved, so that the end plates on two sides form double-layer connecting plates 31, and bolt holes for connection are formed in surfaces of the double-layer connecting plates 31. Due to the above-mentioned structural design, the thickness of bolt connections on ends of the web member 3 is increased, and thus, pressure bearing capacities of the bolts will be greatly improved: for example, for an M10 common bolt with a grade of 8.8S, when a connecting material is Q355, the bearing capacity of the bolt for a 2 mm plate is 10.20 kN, and when the thickness of the plate is 4 mm, the bearing capacity of the bolt will reach 20.40 kN, that is, the bearing capacity of the bolt is multiplied by adopting a flattening process, and a thinner plate can be adopted to achieve a higher bearing capacity. It is worth mentioning that a web plate which is of an arc-shaped structure can also be adopted in the middle of the M-shaped web member 3.

Figure 3:
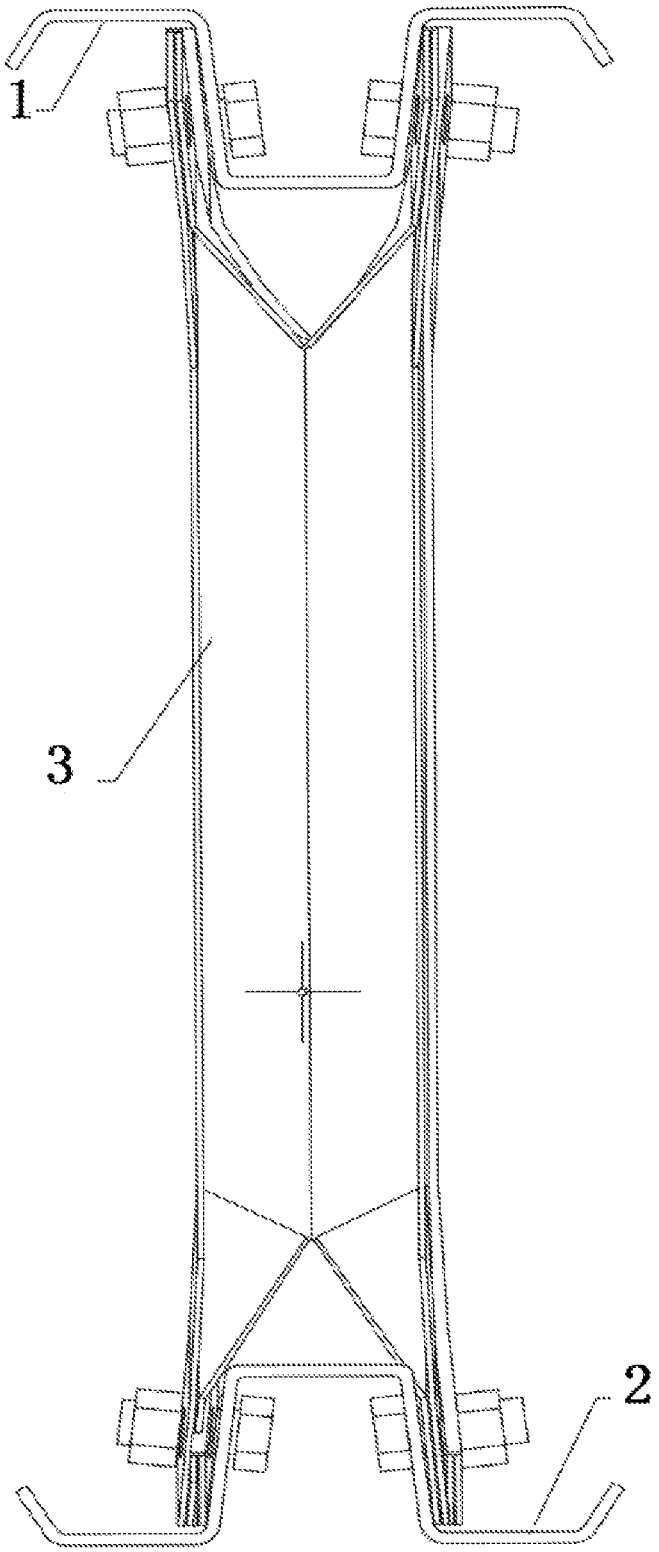
FIG. 3 is a schematic diagram of an assembly structure of a web member and chord members in an embodiment of the present invention.

Specifically, a way that the web members 3 are connected to the chord members are shown in FIG. 1, the plurality of web members 3 are connected end to end and are arranged between the upper chord member 1 and the lower chord member 2 in order, as shown in FIG. 3, the bulges 4 are clamped between the double-layer connecting plates 31 on two sides of the web plate and are spliced, by using bolts, in through holes preformed in the web members 3 and the chord members to realize connection and fixation, and ends of two adjacent web members 3 are connected to the same bolt joint of the upper chord member 1 or the lower chord member 2; and the double-layer connecting plates 31 of the two adjacent web members 3 on the same bolt joint are internally and externally staggered. Therefore, connections of two adjacent web members 3 and the chord members are connected to intersection points of center-of-gravity lines of the web members 3 and the chord members, so that secondary bending moments of the chord members on the joints are avoided, the bearing capacity of the truss is further improved, and then, a heavier load is borne on a smaller sectional area; and the quality and the economic efficiency are greatly improved.

In the present embodiment, a way that the truss is connected to a roof beam 5 is shown in FIG. 5, and the truss is fixed together with the roof beam 5 through a support assembly. The support assembly consists of a support 6 and end support connecting pieces 7: the support 6 is fixed to the roof beam 5, and the end support connecting pieces 7 are two L-shaped steel plates symmetrically disposed on a surface of the support 6 and are fixed together with the support 6 by using bolts; and the bulges 4 on the ends of the upper chord member 1 are clamped between the two end support connecting pieces 7 and are fixed by using bolts.

In the present embodiment, a trapezoidal groove matched with vertical sections of the bulges 4 in shape is formed between the two end support connecting pieces 7, so that sides of the bulges 4 also play a certain supporting role to guarantee the overall force bearing effect. Ends of the lower chord member 2 are lapped-joint on a lower flange of the roof beam 5. The above-mentioned embodiments are merely preferred embodiments of the present invention, but are not intended to limit the present invention in any mode. Any variations such as equivalent substitutions or modifications, etc. made, without departing from the scopes of the technical solutions of the present invention, on the technical solutions and technical contents disclosed in the present invention by the skilled in the art to which the present invention belongs are contents without departing from the technical solutions of the present invention and still fall within the protection scope of the present invention.

The invention claimed is:

1. A fully-bolted assembled truss, comprising a web member for a truss with high sectional strength, including ends, wherein the ends of the web member are flattened to end plates on two sides after a web plate is grooved, so that the end plates on two sides form double-layer connecting plates, and bolt holes for connection that are formed in surfaces of the double-layer connecting plates, wherein a middle section of the web member is M-shaped;

an upper chord member, a lower chord member and a plurality of web members;

the upper chord member being parallel to the lower chord member, sections of the upper chord member and the lower chord member being Q-shaped sections, and middles thereof being bulges for connecting the web members; bolt holes for connection being equidistantly formed in sides of the bulges, and the bulges being clamped between the double-layer connecting plates on two sides of the web plate and being fixedly connected by using bolts;

wherein the truss is fixed together with a roof beam through a support assembly;

wherein the support assembly comprises a support and end support connecting pieces;

the support is fixed to the roof beam, and the end support connecting pieces are two L-shaped steel plates symmetrically disposed on a surface of the support and are fixed together with the support by using bolts; and the bulges on the ends of the upper chord member are clamped between the two end support connecting pieces and are fixed by using bolts.

2. The fully-bolted assembled truss according to claim 1, wherein a trapezoidal groove matched with vertical sections of the bulges in shape is formed between the two end support connecting pieces.

3. A fully-bolted assembled truss, comprising a web member for a truss with high sectional strength, including ends, wherein the ends of the web member are flattened to end plates on two sides after a web plate is grooved, so that the end plates on two sides form double-layer connecting plates, and bolt holes for connection that are formed in surfaces of the double-layer connecting plates;

an upper chord member, a lower chord member and a plurality of web members;

the upper chord member being parallel to the lower chord member, sections of the upper chord member and the lower chord member being Q-shaped sections, and middles thereof being bulges for connecting the web members; bolt holes for connection being equidistantly formed in sides of the bulges, and the bulges being clamped between the double-layer connecting plates on two sides of the web plate and being fixedly connected by using bolts;

wherein the truss is fixed together with a roof beam through a support assembly;

wherein the support assembly comprises a support and end support connecting pieces;

the support is fixed to the roof beam, and the end support connecting pieces are two L-shaped steel plates symmetrically disposed on a surface of the support and are fixed together with the support by using bolts; and the bulges on the ends of the upper chord member are clamped between the two end support connecting pieces and are fixed by using bolts.

4. The fully-bolted assembled truss according to claim 3, wherein a trapezoidal groove matched with vertical sections of the bulges in shape is formed between the two end support connecting pieces.

* * * * *